US005772910A

United States Patent [19]

Yamamoto et al.

[11] Patent Number: 5,772,910

[45] Date of Patent: Jun. 30, 1998

[54] METHOD OF PROVIDING LUBRICITY TO SYNTHETIC YARNS TO BE PROCESSED FOR FALSE TWISTING WITH SHORT HEATER

[75] Inventors: Hisao Yamamoto; Koji Maejima, both of Aichi, Japan

[73] Assignee: Takemoto Yushi Kabushiki Kaisha, Aichi, Japan

[21] Appl. No.: 911,422

[22] Filed: Aug. 14, 1997

[51] Int. Cl.[6] ..... D06M 13/513; D06M 13/517

[52] U.S. Cl. ..... 252/8.84

[58] Field of Search ..... 252/8.84

[56] References Cited

U.S. PATENT DOCUMENTS

| | | | |
|---|---|---|---|
| 3,423,314 | 1/1969 | Campbell | 252/8.84 |
| 3,772,069 | 11/1973 | Daniel | 252/8.84 |
| 4,554,671 | 11/1985 | Ogiso et al. | 252/8.84 |
| 4,561,987 | 12/1985 | Yamamoto et al. | 252/8.84 |
| 5,061,384 | 10/1991 | Suzuki e al. | 252/8.84 |

*Primary Examiner*—David Brunsman
*Attorney, Agent, or Firm*—Keiichi Nishimura

[57] ABSTRACT

A lubricating agent obtained by mixing a polyether compound and linear polyorganosiloxane of a specified type at a specified ratio is applied at a specified rate to synthetic yarns which are to be subjected to a false twisting process by a short heater so as to overcome problems of fuzz, yarn breakage and dyeing specks.

5 Claims, No Drawings

METHOD OF PROVIDING LUBRICITY TO SYNTHETIC YARNS TO BE PROCESSED FOR FALSE TWISTING WITH SHORT HEATER

BACKGROUND OF THE INVENTION

This invention relates to a method of providing lubricity to synthetic yarns which are to be subjected to a false twisting process with a short heater.

When synthetic yarns are subjected to a false twisting process, it is important for obtaining high quality false twisted textured yarns to prevent the generation of fuzz and occurrence of yarn breakage and dyeing specks. For the false twisting of synthetic yarns, it has been known to make use of a false twister with a contact heater, say, of length about 150–250 cm and operating at a temperature of about 150°–230° C. and to cause the yarns to run while contacting a heater plate. Recently, however, a false twister with a short heater, say, of length 20–150 cm and operating at a higher temperature of about 300°–600° C., adapted to cause the yarns to run without contacting the heater plate is coming to be used. Thus, synthetic yarns are subjected to more severe processing conditions and are more likely to generate fuzz and to cause the occurrences of filament breakages and dyeing specks than if a contact heater is used. In other words, the prevention of these problems is more important when a short heater is used in the false twisting process, and this invention relates to a method of providing lubricity to synthetic yarns such that the occurrence of these problems can be effectively eliminated.

It has been known, as means for providing lubricity to synthetic yarns to thereby prevent the occurrence of such problems, to apply a mixture of polyether and polyorganosiloxane compounds as a lubricating agent. Examples of polyorganosiloxane compound to be mixed with a polyether compound to make a lubricating agent for such prior art methods include (1) polydimethylsiloxane and fluoroalkyl modified polydimethyl polysiloxane with viscosity at 25° C. greater than $30\times10^{-6}m^2/s$ and surface tension at 25° C. less than 28 dyne/cm (Japanese Patent Publication Tokkai 54-46923), (2) polydimethylsiloxane with viscosity at 30° C. greater than $15\times10^{-6}m^2/s$ (Japanese Patent Publication Tokkai 48-53093), (3) phenyl polysiloxane with viscosity at 30° C. in the range of $10\times10^{-6}$–$80\times10^{-6}m^2/s$ (Japanese Patent Publication Tokko 47-50657 and U.S. Pat. No. 3,756,972), and (4) polyether modified silicone (Japanese Patent Publication Tokko 63-57548 and U.S. Pat. No. 4,561,987). Although such prior art methods are effective to a certain extent in the case of false twisting processes using a contact heater, their efficacy is extremely unsatisfactory in the case of false twisting processes using a short heater.

SUMMARY OF THE INVENTION

The problem to be overcome by this invention is that prior art methods cannot satisfactorily prevent the generation of fuzz and occurrence of yarn breakage and dyeing specks in false twisting processes using a short heater.

In view of the above, the inventors herein diligently looked for methods of providing lubricity to synthetic yarns to be subjected to a false twisting process by using a short heater such that the occurrence of the problems of the kind described above can be prevented sufficiently effectively. As a result, it was discovered that a desirable result can be obtained if a lubricating agent which is a mixture at a specified ratio of a polyether compound and linear polyorganosiloxane of a specified kind is applied to the synthetic yarn at a specified ratio.

DETAILED DESCRIPTION OF THE INVENTION

This invention relates to a method of providing lubricity to synthesized yarns to be subjected to a false twisting process by using a short heater. The method according to this invention may be characterized by the step of causing a lubricating agent of a specified kind to adhere to the synthetic yarns at a rate of 0.1–3 weight % where the lubricating agent of this specified kind is a mixture of a polyether compound and linear polyorganosiloxane of one or more kinds selected from Type A and Type B defined below, containing them at a weight ratio (polyether compound/linear polyorganosiloxane) of 100/0.05–100/12, Type A being linear polyorganosiloxane having within its molecule 4–12 siloxane units shown below by Formula (1) as repetition units, and Type B being linear polyorganosiloxane having within its molecule as repetition units a total of 4–12 siloxane units shown below by Formula (1) and siloxane units shown below by Formula (2) such that the siloxane units shown by Formula (2) are less than 25 molar % of all siloxane units, Formula (1) being:

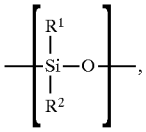

and Formula (2) being:

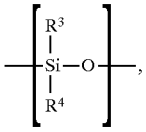

where $R^1$ and $R^2$ are same or different alkyl groups with 1–4 carbon atoms, $R^3$ is fluoroalkyl group with 1–4 carbon atoms, and $R^4$ is fluoroalkyl group with 1–4 carbon atoms or alkyl group with 1–4 carbon atoms.

Examples of siloxane unit shown by Formula (1) include (1) dialkylsiloxane units substituted by the same alkyl groups such as dimethylsiloxane units, diethylsiloxane units, dipropylsiloxane units and dibutylsiloxane units, and (2) dialkylsiloxane units substituted by different alkyl groups such as methylethylsiloxane units and methylbutylsiloxane units. Those of linear polyorganosiloxane of Type A having dimethylsiloxane units as siloxane unit shown by Formula (1) are preferable. Those, of which all of the siloxane units are dimethylsiloxane units, are even more preferable.

Examples of siloxane unit shown by Formula (2) include (1) difluoroalkylsiloxane units and (2) fluoroalkylalkylsiloxane units. Examples of fluoroalkyl group contained in such siloxane units include not only partially fluorinated alkyl groups such as γ-trifluoropropyl group and β,γ-pentafluoropropyl group but also fully fluorinated alkyl groups such as heptafluoropropyl group and pentafluoroethyl group. Those of linear polyorganosiloxane of Type B, of which the siloxane units shown by Formula (1) are dimethylsiloxane units and the siloxane units shown by Formula (2) are partially fluorinated alkyl groups, are preferred. Although the siloxane units shown by Formula (2) in linear polyorganosiloxane of Type B were simply said to be less than 25 molar % of all siloxane units, it is preferable that this ratio be in the range of 1–25 molar %.

Of the linear polyorganosiloxane to be used according to this invention, those having trialkylsilyl group with alkyl group having 1–3 carbon atoms as end group are preferred.

Examples of such trialkylsilyl group include trimethylsilyl group, triethylsilyl group and dimethyl ethylsilyl group but trimethylsilyl group is particularly preferable. It is also preferable to use a mixture of linear polyorganosiloxane having a certain distribution in the repetition number. Of such mixtures, those having viscosity at 25° C. within the range of $3\times10^{-6}$–$9\times10^{-6}m^2/s$, and in particular within the range of $4\times10^{-6}$–$8\times10^{-6}m^2/s$, are preferred.

As for the polyether compound to be mixed with linear polyorganosiloxane according to this invention, use may be made of known kinds such as disclosed in Japanese Patent Publications Tokkai 56-31077 and Tokko 63-57548. Examples of such polyether compound include polyether polyols having oxyethylene units and oxypropylene units as their oxyalkylene units such as polyether monools, polyether diols and polyether triols. According to this invention, it is preferred to use a polyether compound with average molecular weight of 700–20000. Polyether compounds according to this invention include mixtures of polyether compounds having different molecular weights. When such a mixture is used, mixtures of a polyether compound with average molecular weight of 1000–3000 and another with average molecular weight of 5000–15000 are preferred.

As stated above, lubricating agents according to this invention not only comprise a polyether compound and linear polyorganosiloxane but contain them at a weight ratio of 100/0.05–100/12, and more preferably in the range of 100/0.2–100/5.

According to this invention, a lubricating agent as described above is applied to synthetic yarns, which are to be subjected to a heat treatment by a short heater, at a rate of 0.1–3 weight % with respect to the yarns, but more preferably at a rate of 0.2–1 weight %. The application of the lubricating agent is normally effected immediately after the yarns are spun in the spinning process and, after the synthetic yarns with the lubricating agent thus applied thereon are subjected to a winding process, the wound yarns are subjected to a false twisting process by a short heater. Synthetic yarns with a lubricating agent applied thereon may be in the form of undrawn yarns, partially oriented yarns or fully oriented yarns, depending on how they are wound. According to the present invention, however, it is preferable to carry out the winding process at the speed of winding in the range of 2500–7500m/minute to form partially oriented yarns or fully oriented yarns.

As explained above, problems associated with the false twisting of synthetic yarns by a short heater, such as the generation of fuzz and occurrence of yarn breakage and dyeing specks, are prevented according to this invention by applying a suitable lubricating agent at a proper rate so as to provide lubricity. In such a heat treatment process, a heater of temperature 300°–600° C. with length about 20–150 cm is usually used with the synthetic yarns caused to run without contacting its heater plate, but the methods according to this invention are particularly effective in the case of false twisting using a short heater with temperature higher than 350° C. and of length 20–120 cm.

The present invention does not impose any particular limitation on the oiling method for applying a lubricating agent on synthetic yarns. Examples of the oiling method include conventional methods such as the roller oiling method, the guide oiling method by the use of a measuring pump, the dip oiling method and the spray oiling method, but the roller oiling method and the guide oiling method with the use of a measuring pump are preferred oiling methods.

When a lubricating agent of this invention is applied to synthetic yarns, it may be applied in the form of an aqueous emulsion, as a solution with an organic solvent or by itself, but it is preferred to use it as an aqueous emulsion. This may be done by using an appropriate amount of an emulsifier, if necessary, but it is preferred to prepare the aqueous emulsion such that a lubricating agent is contained by 5–30 weight %. When a lubricating agent is applied to synthetic yarns, other agents such as an antistatic agent, an antioxidant, an antiseptic and an antirust agent may be included in the lubricating agent or the aqueous emulsion, depending on the purpose of its use, but their contents should preferably be made as small as possible.

Examples of synthetic yarns, to which the lubricating agents of this invention can be applied, include (1) polyester filaments having ethylene terephthalate as their main constituent units, (2) polyamide filaments such as 6 nylon and 6,6 nylon, (3) polyacryl filaments such as polyacrylnitrile and modacryl filaments, and (4) polyolefin filaments such as polyethylene and polypropylene filaments, but the lubricating agents and methods of this invention are particularly effective when applied to polyester and polyamide filaments and particularly more effective when applied to partially oriented polyester yarns, partially oriented polyamide yarns or direct spin-draw polyester yarns.

Suitable manners of practicing this invention are described next by way of the following ten examples of application:

Application No. 1 wherein lubricating agent (L-1), formed as a mixture of polyether compound (P-1) which is a 50/50 (by weight) mixture of butoxy polyalkyleneglycolether of average molecular weight 1500 and polyalkyleneglycolether of average molecular weight 7000 and linear polydimethylsiloxane (A-1) having within its molecule 8 dimethylsiloxane units as its constituent repetition units and trimethylsilyl group as end group at a weight ratio of (P-1)/(A-1)=100/2, is used by first making an aqueous emulsion thereof, next applying this aqueous emulsion to partially oriented polyester filaments at a rate of 0.4 weight % as lubricating agent (L-1) and subjecting these filaments to a false twisting process using a short heater at temperature of 500° C.;

Application No. 2 wherein lubricating agent (L-2), formed as a mixture of polyether compound (P-1) and linear polydimethylsiloxane (A-1) at a weight ratio of (P-1)/(A-1) =100/5, is used as in Application No. 1;

Application No. 3 wherein lubricating agent (L-3), formed as a mixture of polyether compound (P-1) and linear polydimethylsiloxane (A-2) having within its molecule 11 dimethylsiloxane units as its constituent repetition units and trimethylsilyl group as end group at a weight ratio of (P-1)/(A-2)=100/2, is used by first making an aqueous emulsion thereof, next applying this aqueous emulsion to partially oriented polyester filaments at a rate of 0.4 weight % as lubricating agent (L-3) and subjecting these filaments to a false twisting process using a short heater at temperature of 500° C.;

Application No. 4 wherein lubricating agent (L-4), formed as a mixture of polyether compound (P-1) and linear polydimethylsiloxane (A-2) at a weight ratio of (P-1)/(A-2)=100/5, is used as in Application No. 3;

Application No. 5 wherein lubricating agent (L-5), formed as a mixture of polyether compound (P-1) and linear polyorganosiloxane (B-1) having within its molecule 9 dimethylsiloxane units and one methyl-γ-trifluoropropylsiloxane unit as its constituent repetition units and trimethylsilyl group as end group at a weight ratio of (P-1)/(B-1)=100/2, is used by first making an aqueous emulsion thereof, next applying this aqueous emulsion to partially oriented polyester filaments at a rate of 0.4 weight % as lubricating agent (L-5) and subjecting these filaments to a false twisting process using a short heater at temperature of 500° C.;

Application No. 6 wherein lubricating agent (L-6), formed as a mixture of polyether compound (P-1) and linear polyorganosiloxane (B-1) at a weight ratio of (P-1)/(B-1)=100/5, is used as in Application No. 5;

Application No. 7 wherein lubricating agent (L-7), formed as a mixture of polyether compound (P-2) which is a 90/10 (by weight) mixture of butoxy polyalkyleneglycolether of average molecular weight 1500 and polyalkyleneglycolether of average molecular weight 10000 and linear polydimethylsiloxane (A-1) at a weight ratio of (P-2)/(A-1)=100/0.5, is used by first making an aqueous emulsion thereof, next applying this aqueous emulsion to partially oriented nylon filaments at a rate of 0.45 weight % as lubricating agent (L-7) and subjecting these filaments to a false twisting process using a short heater at temperature of 440° C.;

Application No. 8 wherein lubricating agent (L-8), formed as a mixture of polyether compound (P-2) and linear polyorganosiloxane (B-1) at a weight ratio of (P-2)/(B-1)=100/5, is used as in Application No. 7;

Application No. 9 wherein an aqueous emulsion is made of lubricating agent (L-1) and applied at a rate of 0.4 weight % as lubricating agent (L-1) to direct spin-draw polyester yarns which are then subjected to a false twisting process using a short heater at temperature of 500° C.; and Application No. 10 wherein an aqueous emulsion is made of lubricating agent (L-2) and applied at a rate of 0.4 weight % as lubricating agent (L-2) to direct spin-draw polyester yarns which are then subjected to a false twisting process using a short heater at temperature of 500° C.

EXAMPLES

The invention is explained next by way of test examples and comparison examples, but these test examples are not intended to limit the scope of the invention. In what follows, "part" will mean "weight part" and "%" will mean "weight %."

Part 1 (Preparation of Lubricating Agents)

Lubricating agent (L-1) was prepared by mixing 50 parts of butoxy polyalkyleneglycolether (molar ratio of oxyethylene units to oxypropylene units=70/30, random addition, average molecular weight=1500), 50 parts of polyalkyleneglycolether (molar ratio of oxyethylene units to oxypropylene units=20/80, random addition, average molecular weight=7000) and 2 parts of linear polydimethylsiloxane having within its molecule 8 dimethylsiloxane units as its repetition units and trimethylsilyl group as end group. Other lubricating agents (L-2)-(L-8) and (R-1)-(R-16) were also prepared similarly as shown in Table 1.

TABLE 1

| | Polyether Compound | | Polyorganosiloxane | | | | |
|---|---|---|---|---|---|---|---|
| | | | | Siloxane Unit of Formula 1 | | Siloxane Unit of Formula 2 | |
| | Kind | Amt (%) | Kind | Kind | RN | Kind | RN |
| L-1 | P-1 | 100 | A-1 | DM-1 | 8 | | |
| L-2 | P-1 | 100 | A-1 | DM-1 | 8 | | |
| L-3 | P-1 | 100 | A-2 | DM-1 | 11 | | |

TABLE 1-continued

| | | | | | | | |
|---|---|---|---|---|---|---|---|
| L-4 | P-1 | 100 | A-2 | DM-1 | 11 | | |
| L-5 | P-1 | 100 | B-1 | DM-1 | 5 | MF-1 | 1 |
| L-6 | P-1 | 100 | B-2 | DM-1 | 9 | MF-1 | 1 |
| L-7 | P-2 | 100 | A-1 | DM-1 | 8 | | |
| L-8 | P-2 | 100 | B-1 | DM-1 | 5 | MF-1 | 1 |
| R-1 | P-1 | 100 | C-1 | DM-1 | 3 | | |
| R-2 | P-1 | 100 | C-2 | DM-1 | 14 | | |
| R-3 | P-1 | 100 | C-3 | DM-1 | 2 | MF-1 | 1 |
| R-4 | P-1 | 100 | C-4 | DM-1 | 13 | MF-1 | 1 |
| R-5 | P-1 | 100 | C-5 | | | | |
| R-6 | P-1 | 100 | C-6 | DM-1 | 13 | M-1 | |
| R-7 | P-1 | 100 | C-7 | | | | |
| R-8 | P-1 | 100 | | | | | |
| R-9 | P-2 | 100 | C-1 | DM-1 | 3 | | |
| R-10 | P-2 | 100 | C-2 | DM-1 | 14 | | |
| R-11 | P-2 | 100 | C-3 | DM-1 | 2 | MF-1 | 1 |
| R-12 | P-2 | 100 | C-4 | DM-1 | 13 | MF-1 | 1 |
| R-13 | P-2 | 100 | C-5 | | | | |
| R-14 | P-2 | 100 | C-6 | DM-1 | 13 | M-1 | 1 |
| R-15 | P-2 | 100 | C-7 | | | | |
| R-16 | P-2 | 100 | A-1 | DM-1 | 8 | | |

| | Polyorganosiloxane | | | | |
|---|---|---|---|---|---|
| | Terminal Group | | | | |
| | Kind | Amt (%) | Viscosity | Amount (Part) | Weight Ratio |
| L-1 | TM-1 | 2 | 5.0 | 2 | 100/2 |
| L-2 | TM-I | 2 | 5.0 | 5 | 100/5 |
| L-3 | TM-1 | 2 | 7.5 | 2 | 100/2 |
| L-4 | TM-1 | 2 | 7.5 | 5 | 100/5 |
| L-5 | TM-1 | 2 | 5.0 | 2 | 100/2 |
| L-6 | TM-1 | 2 | 8.5 | 5 | 100/5 |
| L-7 | TM-1 | 2 | 5.0 | 0.5 | 100/0.5 |
| L-8 | TM-1 | 2 | 5.0 | 5 | 100/5 |
| R-1 | TM-1 | 2 | 2.0 | 5 | 100/5 |
| R-2 | TM-1 | 2 | 11.0 | 5 | 100/5 |
| R-3 | TM-1 | 2 | 2.5 | 5 | 100/5 |
| R-4 | TM-1 | 2 | 13.0 | 5 | 100/5 |
| R-5 | | | 40.0 | 5 | 100/5 |
| R-6 | TM-1 | 2 | 14.0 | 5 | 100/5 |
| R-7 | | | 750 | 5 | 100/5 |
| R-8 | | | | | 100/0 |
| R-9 | TM-1 | 2 | 2.0 | 5 | 100/5 |
| R-10 | TM-1 | 2 | 11.0 | 5 | 100/5 |
| R-11 | TM-1 | 2 | 2.5 | 5 | 100/5 |
| R-12 | TM-1 | 2 | 13.0 | 5 | 100/5 |
| R-13 | | | 40.0 | 5 | 100/5 |
| R-14 | TM-1 | 2 | 14.0 | 5 | 100/5 |
| R-15 | | | 750 | 5 | 100/5 |
| R-16 | TM-1 | 2 | 5.0 | 15 | 100/15 |

In Table 1:

RN: Repetition number

Viscosity: Viscosity at 25° C. in units of $10^{-6}m^2/s$

Weight Ratio: Weight ratio between polyether compound and polyorganosiloxane

Amt: Amount which was used

P-1: Mixture of 50 parts of butoxy polyalkyleneglycolether of average molecular weight 1500 obtained by random addition of oxyethylene units and oxypropylene units at molar ratio of 70/30 and 50 parts of polyalkyleneglycolether of average molecular weight 7000 obtained by random addition of oxyethylene units and oxypropylene units at molar ratio of 20/80

P-2: Mixture of 90 parts of butoxy polyalkyleneglycolether of average molecular weight 1500 obtained by random addition of oxyethylene units and oxypropylene units at molar ratio of 60/40 and 10 parts of polyalkyleneglycolether of average molecular weight 10000 obtained by random addition of oxyethylene units and oxypropylene units at molar ratio of 25/75

DM-1: Dimethylsiloxane unit

MF-1: Methyl-γ-trifluoropropylsiloxane unit

M-1: Methylphenylsiloxane unit

C-5: Linear polydimethylsiloxane with average molecular weight 3000

C-7: Polyether modified silicone with average molecular weight 8600 with 92 weight % of polyoxyalkyleneether block obtained by random addition of oxyethylene units and oxypropylene units at molar ratio of 15/15.

Part 2 (Adhesion of Lubricating Agents onto Partially Oriented Polyester Yarns and Its Evaluations)

An aqueous emulsion with 15% concentration of lubricating agent was obtained by mixing 3 parts of dibutylethanolamine salt of polyoxyethylene (4) laurylether phosphate as antistatic agent and 7 parts of polyoxyethylene (7) nonylphenylether as emulsifier to 100 parts of each lubricating agent obtained in Part 1 and adding water to this mixture. After a polyethylene terephthalate chip with intrinsic viscosity 0.64 containing titanium oxide by 0.6 weight % was dried by a conventional method, it was spun by means of an extruder. The aqueous emulsion was applied by a roller oiling method to the running filaments which were extruded from the spinneret and cooled for caking, and the filaments were wound up at the rate of 3400 m/minute without mechanical drawing to obtain a wound 10 kg cake of 75-denier, 96-filament partially oriented yarns, as shown in Table 2.

Each of the cakes, obtained as described above, was used to carry out false twisting by using a false twister with a short heater described below and the generation of fuzz and occurrence of yarn breakage and dyeing specks were evaluated:

False twister with a high temperature short heater: Model HTS-1500 of Teijin Seiki Co., Ltd.

Speed of yarn: 1100 m/minute

Draw ratio: 1.518

Twisting system: One guide disk on entrance side, one guide disk on exit side, and seven hard polyurethane rubber disks Heater on twist side: 1 m in length with entrance section of 25 cm and exit section of 75 cm and surface temperature 500° C. at the entrance section and 420° C. at the exit section Heater on untwisting side: None Intended number of twisting: 3400 t/m Days of continuous operation: 20

After a continuous operation for 20 days under the conditions given above, 2-kg wound cheeses of textured yarns were obtained.

Generation of fuzz was evaluated by selecting 10 of the cheeses of textured yarn at random, measuring the number of fuzz on their side surfaces and evaluating in terms of the average number of fuzz per cheese.

Yarn breakage was evaluated by counting the total frequency of yarn breakage during the 20-day period of operation for 10 spindles and obtaining the average frequency of yarn breakage per spindle.

Dyeing specks were evaluated according to the following standards after selecting two of the cheeses of textured yarns at random, producing knit materials from them, dyeing them by a conventional method and visually observing these dyed materials:

A: Unevenness in dyeing not observed

B: Dyeing specks at one or two places

C: Significant unevenness in dyeing

Generation of fuzz and occurrence of yarn breakage and dyeing specks were comprehensively evaluated as follows:

A: Significantly few occurrences

B: Few occurrences

C: Many occurrences

D: Significantly many occurrences

These results are shown in Table 2.

TABLE 2

| Lubricating agent which was used | Adhesion Percentage (%) | Evaluation of Problems: Fuzz | Yarn Breakage (Times) | Dyeing Specks | Overall |
|---|---|---|---|---|---|
| | | Test Examples | | | |
| L-1 | 0.4 | 2 | 3 | A | A |
| L-2 | 0.4 | 0 | 1 | A | A |
| L-3 | 0.4 | 2 | 1 | A | A |
| L-4 | 0.4 | 1 | 3 | A | A |
| L-5 | 0.4 | 1 | 4 | A | A |
| L-6 | 0.4 | 3 | 6 | A | A |
| | | Comparison Examples | | | |
| R-1 | 0.4 | 11 | 16 | B | C |
| R-2 | 0.4 | 18 | 23 | C | D |
| R-3 | 0.4 | 12 | 14 | B | C |
| R-4 | 0.4 | 18 | 20 | C | D |
| R-5 | 0.4 | 23 | 37 | C | D |
| R-6 | 0.4 | 26 | 35 | C | D |
| R-7 | 0.4 | 13 | 12 | B | C |
| R-8 | 0.4 | 11 | 17 | B | C |
| R-9 | 0.4 | 10 | 14 | B | C |
| R-10 | 0.4 | 15 | 20 | C | D |
| R-16 | 0.4 | 17 | 11 | B | C |
| L-6 | 0.05 | 35 | 42 | C | D |
| L-6 | 5.0 | 32 | 40 | C | D |

Part 3 (Adhesion of Lubricating Agents onto Partially Oriented Nylon Yarns and Its Evaluations)

An aqueous emulsion with 10% concentration of lubricating agent was obtained by mixing 2 parts of potassium salt of polyoxyethylene (3) oleylether phosphate and 3 parts of trioctylamine oxide as antistatic agent, and 5 parts of polyoxyethylene (8) octylether as emulsifier to 100 parts of each lubricating agent obtained in Part 1 and adding water to this mixture. After a nylon 6,6 chip with sulfuric acid relative viscosity 2.4 containing titanium oxide by 0.3 weight % was dried by a conventional method, it was spun by means of an extruder at 290° C. The aqueous emulsion was applied by a guide oiling method to the running filaments which were extruded from the spinneret and cooled for caking, and the filaments were wound up at the rate of 4100 m/minute without mechanical drawing to obtain a wound 8 kg cake of 30-denier, 10-filament partially oriented yarns, as shown in Table 3.

Each of the cakes, obtained as described above, was used to carry out false twisting under the same conditions as in Part 2 except the following:

Speed of yarn: 1200 m/minute

Draw ratio: 1.220

Twisting system: One guide disk on entrance side, one guide disk on exit side, and five ceramic disks Heater on twist side: surface temperature 440° C. at the entrance section and 360° C. at the exit section Intended number of twisting: 3000 t/m.

Generation of fuzz and occurrence of yarn breakage and dyeing specks were evaluated as in Part 2.

TABLE 3

| Lubricating agent which was used | Adhesion Percentage (%) | Evaluation of Problems: Fuzz | Yarn Breakage (Times) | Dyeing Specks | Overall |
|---|---|---|---|---|---|
| | | Test Examples | | | |
| L-7 | 0.45 | 2 | 4 | A | A |
| L-8 | 0.45 | 0 | 2 | A | A |
| | | Comparison Examples | | | |
| R-9 | 0.45 | 13 | 9 | B | C |
| R-10 | 0.45 | 14 | 19 | C | D |
| R-11 | 0.45 | 12 | 11 | B | C |
| R-12 | 0.45 | 17 | 21 | C | D |
| R-13 | 0.45 | 28 | 25 | C | D |
| R-14 | 0.45 | 30 | 28 | C | D |
| R-15 | 0.45 | 14 | 10 | B | C |
| R-16 | 0.45 | 12 | 11 | B | C |
| L-8 | 0.05 | 31 | 38 | C | D |
| L-8 | 5.0 | 34 | 44 | C | D |

Part 4 (Adhesion of Lubricating Agents onto Direct Spin-Draw Polyester Yarns and Its Evaluations)

An aqueous emulsion with 10% concentration of lubricating agent was obtained by mixing 2 parts of triethanolamine salt of isostearic acid as antistatic agent and 8 parts of polyoxyethylene (15) castor oil ether as emulsifier to 100 parts of each lubricating agent obtained in Part 1 and adding water to this mixture. The aqueous emulsion was applied by a guide oiling method to the running polyester filaments which were pulled by a first godet roller rotating at 4000 m/minute and mechanically drawn between a second godet roller and the first godet roller and wound up at the rate of 6000 m/minute to obtain a wound 5 kg cake of 50-denier, 24-filament direct spin-draw yarns.

Each of the cakes, obtained as described above, was used to carry out false twisting under the same conditions as in Part 2 except the draw ratio was 1.518, the overfeed ratio was 3% and the false twisting speed of yarn was 800 m/minute. Generation of fuzz and occurrence of yarn breakage and dyeing specks were evaluated as done in Part 2. The results are shown in Table 4.

It should be clear from all these results that the present invention makes it possible to effectively eliminate the problems of fuzz, yarn breakage and dyeing specks in the false twisting process of synthetic yarns.

TABLE 4

| Lubricating agent which was used | Evaluation of Problems: Fuzz | Yarn Breakage (Times) | Dyeing Specks | Overall |
|---|---|---|---|---|
| | Test Examples | | | |
| L-1 | 2 | 3 | A | A |
| L-2 | 0 | 2 | A | A |
| | Comparison Examples | | | |
| R-1 | 12 | 10 | B | C |
| R-3 | 13 | 12 | B | C |
| R-4 | 16 | 14 | C | D |
| R-5 | 22 | 15 | C | D |
| R-6 | 27 | 21 | C | D |
| R-7 | 11 | 12 | B | C |

What is claimed is:

1. A method of providing lubricity to synthetic yarns which are to be subjected to a false twisting process with a short heater, said method comprising the step of applying a lubricating agent to the synthetic yarns at a rate of 0.1–3 weight % of said synthetic yarns, said lubricating agent comprising a polyether compound and linear polyorganosiloxane of one or more kinds selected from Type A and Type B at a weight ratio of (polyether compound/linear polyorganosiloxane)=100/0.05–100/12, said Type A being linear polyorganosiloxane having within the molecule thereof 4–12 siloxane units shown by Formula (1) as constituent units thereof, said Type B being linear polyorganosiloxane having within the molecule thereof a total of 4–12 siloxane units shown by Formula (1) and siloxane units shown by Formula (2) as constituent repetition units such that the siloxane units shown by Formula (2) are less than 25 molar % of all siloxane units of said Type B, Formula (1) being:

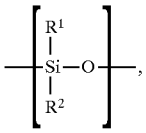

and Formula (2) being:

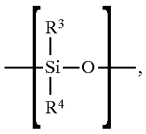

where $R^1$ and $R^2$ are same or different alkyl groups with 1–4 carbon atoms, $R^3$ is fluoroalkyl group with 1–4 carbon atoms, and $R^4$ is fluoroalkyl group with 1–4 carbon atoms or alkyl group with 1–4 carbon atoms.

2. The method of claim 1 wherein the siloxane units shown by Formula (1) of said linear polyorganosiloxane are dimethylsiloxane units.

3. The method of claim 2 wherein said linear polyorganosiloxane has an end group which is trialkylsilyl group having alkyl group with 1–3 carbon atoms.

4. The method of claim 3 wherein the average molecular weight of said polyether compound is 700–20000.

5. The method of claim 3 wherein said polyether compound is a mixture of polyether compound of first kind with average molecular weight of 1000–3000 and polyether compound of second kind with average molecular weight of 5000–15000.

* * * * *